United States Patent [19]

Schwob et al.

[11] Patent Number: 4,673,909

[45] Date of Patent: Jun. 16, 1987

[54] THERMAL CUTOUT

[75] Inventors: Pierre Schwob, Lyons; Daniel Bontoux, St Genis Laval, both of France

[73] Assignee: SEB S.A., Selongey, France

[21] Appl. No.: 869,970

[22] Filed: Jun. 2, 1986

[30] Foreign Application Priority Data

Jun. 14, 1985 [FR] France ..... 85 09030

[51] Int. Cl.[4] ..... H01H 37/76

[52] U.S. Cl. ..... 337/407; 337/408

[58] Field of Search ..... 337/407, 408, 409

[56] References Cited

U.S. PATENT DOCUMENTS

| | | | |
|---|---|---|---|
| 3,291,945 | 12/1966 | Merrill et al. | 337/407 |
| 4,186,366 | 1/1980 | McVey | 337/408 |
| 4,383,236 | 5/1983 | Urani et al. | 337/407 |
| 4,408,178 | 10/1983 | Hanssen et al. | 337/320 |

FOREIGN PATENT DOCUMENTS

| | | |
|---|---|---|
| 2716579 | 10/1977 | Fed. Rep. of Germany . |
| 2174818 | 10/1973 | France . |
| 2428908 | 1/1980 | France . |
| 963064 | 7/1964 | United Kingdom . |
| 2001474 | 1/1979 | United Kingdom . |
| 2005477 | 4/1979 | United Kingdom . |

*Primary Examiner*—Harold Broome

*Attorney, Agent, or Firm*—Young & Thompson

[57] ABSTRACT

The thermal cutout comprises a casing (1) in which at least a portion of casing (3) is of heat-conducting material, two terminals (5) carried by an electrically insulating plug (4) and an electrically conductive moving element (6) maintained in contact with each terminal (5) by a member (8) which is deformable under the action of heat and which is in turn in contact with the heat-conducting portion of casing (3). The cutout essentially comprises a translationally displaceable electrically insulating member (7) forming a separation between on the one hand the heat-deformable member (8) and on the other hand the terminals (5) and the electrically conductive element (6).

9 Claims, 3 Drawing Figures

THERMAL CUTOUT

BACKGROUND OF THE INVENTION

The present invention relates to a thermal cutout and more particularly to a thermal cutout set to operate at a predetermined temperature for ensuring protection of electric heating appliances for household use, especially laundry irons.

This type of cutout is not intended to act as a device for regulating the temperature of the domestic appliance in which it is mounted but has the sole function of a safety device in the event that the regulating system has failed to operate and that the domestic appliance is therefore subjected to an abnormal temperature rise.

In order to carry out its function, the cutout must come into operation as soon as an unusual temperature is attained and before the appliance to be protected has sustained any damage. To this end, it is necessary to ensure good heat transfer between the heating element to be controlled and the cutout.

For this reason, the cutout is preferably in direct contact with the heating element to be controlled. However, in the case of small domestic appliances such as laundry irons, for example, the space available for putting the cutout in contact with the heating element is limited by reason of the different accessories which surround the heating element and which are necessary for the operation of the domestic appliance. Thus in the case of an electric steam-iron, the heating element is constituted by the sole-plate of the iron, a large part of which is made unavailable by the presence of the heating resistor, of the steam-generating zone and of the zone of contact with the regulating means.

In consequence, the cutout has to be miniaturized for maximum utilization of available space.

Taking cost requirements into account, it is also necessary to ensure that the cutout structure is compatible with very high speed mass-production assembly operations performed by means of automatic machines.

Miniaturized thermal cutouts having good heat-transfer characteristics are already known. In particular, U.S. Pat. No. 3,291,945 describes a thermal cutout comprising a heat-conducting casing, two terminals carried by an electrically insulating plug and an electrically conductive moving element maintained in contact with each terminal by a fusible pellet which is in turn in contact with the casing. However, in accordance with the teachings of this patent, the fusible pellet must be formed of electrically insulating material. If this condition is not satisfied, the conductors are electrically connected to the casing, thus constituting a permanent short-circuit or a connection to ground even when the pellet has melted by reason of a general temperature rise. Furthermore, it is known that electrically insulating fusible pellet are usually fabricated from organic material which sublimes slowly at the normal utilization temperatures of a domestic heating appliance. If a cutout of the type described in U.S. Pat. No. 3,291,945 is employed in a domestic heating appliance, the fusible pellet therefore sublimes progressively in the course of normal operation of the appliance and the cutout finally operates or "blows" when the domestic appliance has not been subjected to any abnormal increase in temperature. This operational fault condition makes it necessary to replace the cutout, which is incompatible with the market requirements of potential non-professional users of the appliance.

British patent Application No. 2,005,477 describes a rechargeable thermal cutout having rotary contacts and a relatively complex structure which is not compatible with very rapid mass-production assembly operations.

SUMMARY OF THE INVENTION

One object of the present invention is to provide a thermal cutout which is sufficiently sensitive and miniaturized while maintaining in service the domestic appliance in which it is mounted as long as the temperature of this appliance is not abnormal.

With this objective, the invention provides a thermal cutout comprising a casing in which at least a portion of casing is of heat-conducting material, two terminals carried by an electrically insulating plug, and an electrically conductive moving element maintained in contact with each terminal by a member which is deformable under the action of heat and which is in turn in contact with the heat-conducting portion of casing. The cutout essentially comprises a translationally displaceable electrically insulating member placed between said moving element and said heat-deformable member, said displaceable member being intended to form a separation between on the one hand the heat-deformable member and on the other hand the terminals and the electrically conductive element.

The heat-deformable member can thus be made without difficulty in the form of a conductive pellet, for example of a metal alloy which has a precise melting point above the normal operating temperature of the appliance in which the cutout is mounted and which does not sublime at temperatures below the normal operating temperature. Moreover, at the time of melting of the pellet, the displaceable member forms a partition which prevents the molten material from flowing back to the terminals and re-establishing the electric circuit which has been interrupted or connecting the appliance to ground.

In an advantageous embodiment of the invention, the heat-deformable member is a fusible pellet and the displaceable member has a portion in the form of a punch which extends towards the fusible pellet. Thus, when the pellet melts, the displaceable member moves in order to open the cutout without resulting in any substantial flow of molten material.

In a preferred embodiment of the invention, the heat-conducting portion of casing comprises an annular partition which extends towards the displaceable member and surrounds the fusible pellet. The result thereby achieved is that the volume of the pellet is reduced to the volume delimited by the annular partition and that a thermal cutout having very low inertia is accordingly obtained.

According to another aspect of the invention, a peripheral groove is formed in the plug and the casing is crimped into said groove. Thus, at the time of construction and assembly of the cutout, the crimping operation is effectively performed at a constant level without any need to take into account any variations in height of the stack of components which result from manufacturing tolerances of each component.

BRIEF DESCRIPTION OF THE DRAWINGS

Other features of the invention will be more apparent to those skilled in the art upon consideration of the following description and accompanying drawings, wherein.

DESCRIPTION OF THE PREFERRED EMBODIMENTS

Figure 1:
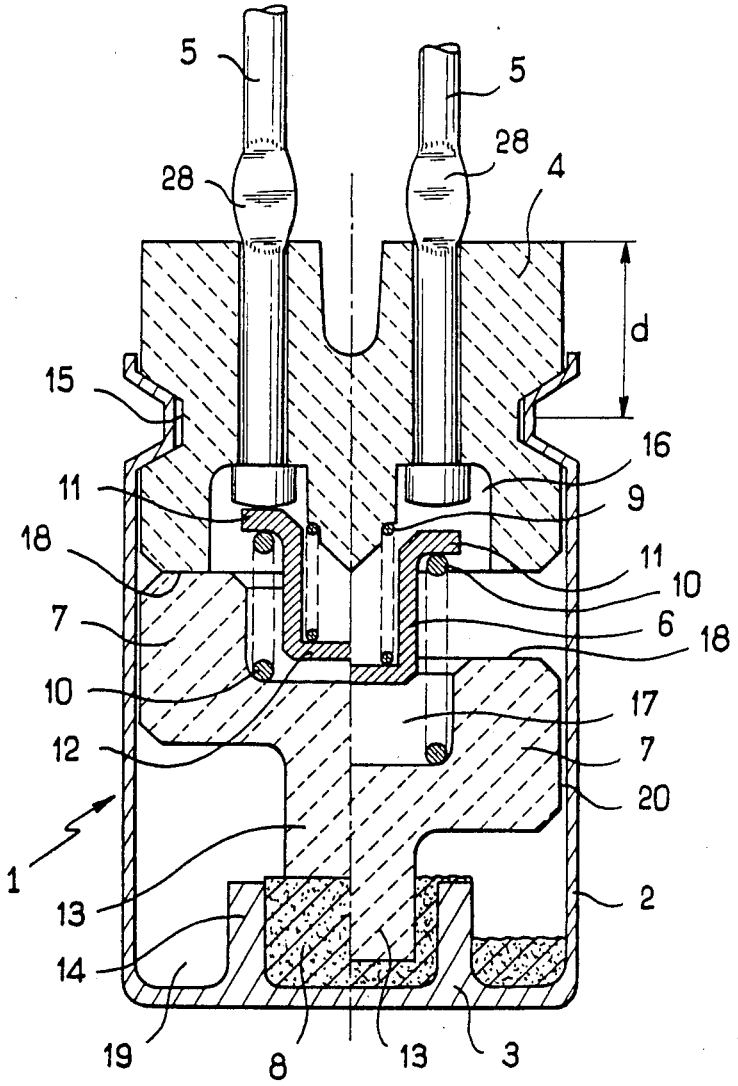
FIG. 1 is an axial sectional view of a first embodiment of the invention.

Reference being made to FIG. 1, the left-hand portion of the figure illustrates the cutout in the normal position of use and the right-hand portion shows the cutout after a blowout resulting from an abnormal increase in the temperature of the appliance in which the cutout has been mounted. The view of the cutout shown in the figure is highly enlarged for the sake of enhanced clarity. The cutout comprises a casing generally designated by the reference 1, the casing being constituted by a cylindrical side wall 2 and a bottom end-wall 3. The casing 1 is formed of heat-conducting material and preferably in a single operation such as, for example, extrusion-pressing of an aluminum blank (or so-called pellet).

At the end opposite to the bottom end-wall 3, the casing 1 is closed by a plug 4 traversed by electric terminals 5 placed side by side. The plug 4 is formed of electrically insulating material such as ceramic material, for example, and the terminals 5 are therefore electrically isolated from the heat-conducting casing 1.

The terminals 5 extend on the one hand outwards from the cutout and can be connected externally of this latter to the electric circuit of the heating apparatus to be protected against fault conditions and on the other hand towards the interior of said cutout in which they are connected electrically by means of an electrically conductive moving element 6. Said element 6 is maintained in contact with each terminal 5 by means of a displaceable insulating member 7 supported by a heat-deformable member 8 which is in contact with the bottom end-wall 3 of the casing. By way of example, the heat-deformable member 8 is a fusible pellet of metal alloy having a base of lead, tin and bismuth.

In this first example of construction, the conductive moving element 6 is a cup-shaped metal plate which is placed opposite to the terminals 5 and is subjected to the opposing action of springs 9 and 10, the spring 9 being placed above the cup 6 and the spring 10 being placed beneath this latter. The cup 6 has a flange 11 and a bottom portion 12 which are connected by a side wall. The spring 10 is a cylindrical helical spring having a diameter which is substantially equal to that of the flange 11 and the spring 9 is a cylindrical helical spring whose diameter is close in value to the diameter of the disk 12 which forms the bottom portion of the cup, with the result that, at the time of assembly, the springs 9 and 10 and the cup 6 are automatically centered with respect to each other. The spring 10 is so dimensioned that, in the compressed state, it exerts a larger force than that of the spring 9 and thus maintains the flange 11 against the terminals 5 in order to close the electric circuit between these terminals.

The displaceable member 7 which is formed of insulating material such as ceramic material, for example, also has a lower end in the form of a punch 13 which extends towards the deformable pellet 8. The bottom end-wall 3 of the casing 1 has an annular partition 14 which extends towards the displaceable member 7 and surrounds the deformable pellet 8.

In this preferred embodiment, the plug 4 is also provided with a peripheral groove 15 located at a distance d from the top face of the plug 4.

Assembly of the cutout in accordance with the invention is preferably performed in reverse. In other words, the plug 4 is first placed on a reference surface and a stack is then formed by the following elements placed one above the other in succession: the spring 9, the cup 6, the spring 10, the displaceable member 7 and the casing 1 in which the pellet 8 has been fitted beforehand. It is then found that the casing 1 engages on the plug 4 to a greater or lesser extent as a function of the height of the displaceable member 7 and the thickness of the pellet 8 which varies to a slight extent according to manufacturing tolerances. Automatic crimping can nevertheless be performed without difficulty. The only essential requirement for this operation is that the distance d between the external face of the plug 4 and the groove 15 must be maintained at a constant value. After assembly, the components are in the position shown in the left half of FIG. 1, in which the cup 6 ensures an electrical contact between the terminals 5 whereas these latter are isolated from the casing by means of the plug 4 and the displaceable member 7. It will be noted in this connection that, in the preferred embodiment, the terminals 5 are placed within a cavity 16 of the plug 4 and the displaceable member 7 is provided with a cavity 17 located opposite to the cavity 16, a portion of surface 18 of said displaceable member 7 being in contact with the plug 4. Thus the cutout can be placed without any attendant risk of damage in a highly charged atmosphere such as, for example, in proximity to the steam-generating chamber of an electric laundry iron.

In the event of abnormal overheating of the domestic appliance in which the cutout is mounted, the pellet 8 melts and the displaceable member 7 sinks into the molten material under the action of the springs 9 and 10. During this movement, the spring 10 expands up to the moment when the force exerted by this latter on the cup 6 becomes smaller than the force exerted by the spring 9, which accordingly has the effect of moving the cup 6 away from the terminals 5 and of opening the electric circuit between said terminals. It is observed that the molten material of the pellet 8 is capable of flowing freely into the cavity 19 which surrounds the lower portion of the displaceable member 7. It will be noted in this connection that a clearance space 20 can be provided between the displaceable member 7 and the side wall of the casing 1. In the case of fusible conductive material, said clearance space 20 must nevertheless be of sufficiently small width to set up resistance to flow, thus preventing said fusible conductive material from flowing back towards the terminals 5 and re-establishing the electric circuit between these latter.

Figure 2:
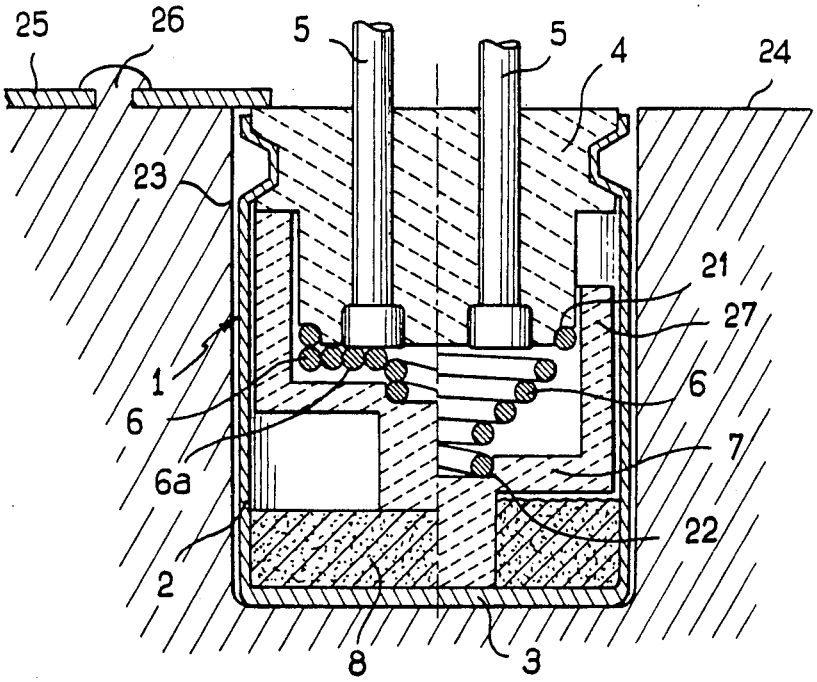
FIG. 2 is an axial sectional view of a second embodiment of the invention.

FIG. 2 illustrates a second embodiment of the cutout in accordance with the invention. As in the previous embodiment, the cutout comprises a casing 1 having a side wall 2 and a bottom end-wall 3, this casing being again closed by a plug 4 through which extend terminals 5. In this instance, the conductive moving element 6 is a helical spring so designed that the diameter of at least one turn 6*a* is different from the diameter of the other turns. Said spring is arranged with respect to the terminals 5 so as to be in contact with these latter prior to overheating of the pellet 8 and so as to be moved away from at least one terminal as and when overheating of said pellet occurs. Preferably, the spring 6 is substantially frustoconical in the rest position.

In the particular example shown in the figure, the end portion of the helical spring 6 which has the largest diameter is located nearest the plug 4 and inserted in an annular groove 21 formed in the bottom face of the plug 4 whilst the small-diameter end portion of the spring is applied against the top surface of the displaceable member 7 and maintained centered on this latter by a circular shoulder 22. In the preferential application under consideration, the cutout is mounted within a cylindrical cavity 23 of a sole-plate 24 of a laundry iron and is held in place within said cavity by a washer 25 attached to the top portion of the sole-plate 24 by means of a stud 26 which is formed at the top surface of the sole-plate 24 in proximity to the cavity 23 and the head of which is flattened against the washer 25, with the result that the edge of the washer 25 overhangs the top portion of the cutout and thus maintains the bottom end-wall 3 of the casing 1 in contact with the bottom face of the cavity 23.

In this embodiment, the displaceable member 7 also has a portion of annular wall 27 which surrounds the lower portion of the plug. Thus, even when the cutout is in the blowout position, the portion of wall 27 forms with the oppositely-facing portion of the plug 4 a baffle which prevents in a complementary manner any backflow of fusible material towards the terminals 5.

Figure 3:
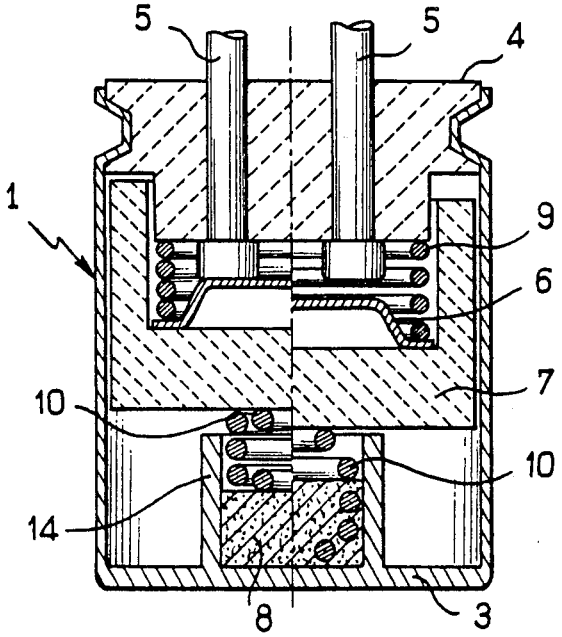
FIG. 3 is an axial sectional view of a third embodiment of the invention.

FIG. 3 illustrates a third embodiment which, as in the first embodiment, comprises a conductive moving element 6 formed by a metal plate which is urged by a helical spring 9 in the direction of opening of the contact. However, in this case, the metal plate 6 is directly supported by the displaceable member 7 and the spring 10 which acts in opposition to the spring 9 is placed beneath the displaceable member 7. Thus, at the time of melting of the pellet 8, the spring 10 expands within the molten fusible material and produces a slight displacement of said molten material which thus remains totally contained within the annular wall 14.

As will be readily apparent, the invention is not limited to the embodiments described in the foregoing and alternative forms of construction may accordingly be contemplated.

By way of example, the heat-deformable pellet 8 can be replaced by a bimetallic strip or a single-turn coil of metal having a shape memory.

Leak-tightness between the plug 4 and the casing 1 can be obtained by making use of a plug of slightly deformable organic material which is forcibly inserted in the casing at the moment of assembly.

Although the attachment of the terminals 5 to the plug 4 has been represented in the form of a flattened portion 28, arrangements can be made to clamp the tail portion of the terminal 5 in the same manner as a rivet, the clamping operation being intended at the same time to maintain a small elbowed plate in contact with the terminal 5 for subsequent coupling with a quick-action connector.

What is claimed is:

1. A thermal cutout comprising a casing (1) of which at least a portion (3) is of heat-conducting material, two terminals (5) carried by an electrically insulating plug (4) secured to the casing, and an electrically conductive moving element (6) maintained in contact with each terminal (5) by a member (8) which is deformable under the action of heat and which is in turn in contact with the heat-conducting portion (3) of the casing (1), said thermal cutout comprising an electrically insulating member (7) translationally displaceable between a normal position wherein said member has a surface portion (18) in contact with the plug (4) and an opposite surface portion in contact with the heat-deformable member (8), and a fused position wherein an end portion (13) of said displaceable member (7) has penetrated into said deformable member (8) and wherein said surface portion (18) opposite to said end portion (13) is spaced from the plug (4), whereby said displaceable member (7) forms an isolating separation between on the one hand the heat-deformable member (8) and on the other hand the terminals (5) and the electrically conductive moving element (6) and allows electrical disconnection between the terminals (5) and the conductive moving element (6), the terminals (5) and the electrically conductive moving element (6) in said normal position being enclosed within an internal cavity (16, 17) delimited by opposite portions of a wall of said plug (4) and of said displaceable member (7).

2. A thermal cutout according to claim 1, wherein the heat-deformable member is a fusible pellet (8) and wherein said displaceable member end portion (13) has the form of a punch extending toward said fusible pellet (8).

3. A thermal cutout according to claim 2, wherein the heat-conducting portion (3) of the casing comprises an annular partition (14) which extends toward the displaceable member (7) and surrounds the fusible pellet (8).

4. A thermal cutout according to claim 1, wherein a peripheral groove (15) is formed in the plug (4) and wherein the casing is crimped into said groove.

5. A thermal cutout according to claim 1, wherein the displaceable member (7) has a wall (27) having an annular portion, which surrounds part of the plug (4).

6. A thermal cutout according to claim 1, wherein the conductive moving element is a helical spring (6) in which at least one turn **(6*a*) has a diameter which is different from the others, said turn being placed with respect to the terminals (5) so as to be in contact therewith prior to overheating of the heat-deformable member (8) and so as to be moved away from at least one of said terminals at the time of overheating of said deformable member (8)**.

7. A thermal cutout according to claim 6, wherein the spring (6) is substantially frusto-conical in said fused position.

8. A thermal cutout according to claim 1, wherein the conductive moving element is a metal plate (6) placed opposite to the terminals (5) and wherein springs (9, 10) act on the plate (6) in opposite directions, one said spring (9) being placed above the plate (6) and another said spring (10) being placed beneath this latter, the springs (9, 10) and plate (6) being centered with respect to each other.

9. A thermal cutout according to claim 8, wherein the metal plate (6) is supported by the displaceable member (7) and wherein the oppositely-acting springs are so arranged that one spring (9) produces action on the metal plate (6) and the other spring (10) produces action on said displaceable member.

* * * * *